US010407278B2

(12) United States Patent
Zhang et al.

(10) Patent No.: US 10,407,278 B2
(45) Date of Patent: Sep. 10, 2019

(54) SAFETY DEVICE FOR ELEVATORS

(71) Applicant: Otis Elevator Company, Farmington, CT (US)

(72) Inventors: Lifeng Zhang, Shanghai (CN); James M. Draper, Woodstock, CT (US); Byeongsam Yoo, Gyeonggi do (KR); Min Wang, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 391 days.

(21) Appl. No.: 15/258,414

(22) Filed: Sep. 7, 2016

(65) Prior Publication Data

US 2017/0066628 A1 Mar. 9, 2017

(30) Foreign Application Priority Data

Sep. 8, 2015 (CN) ..... 2015 1 0564637

(51) Int. Cl.
*B66B 5/22* (2006.01)

(52) U.S. Cl.
CPC ..... *B66B 5/22* (2013.01)

(58) Field of Classification Search
CPC ..... B66B 5/22; B66B 5/18; F16D 63/008
See application file for complete search history.

(56) References Cited

U.S. PATENT DOCUMENTS 2,150,373 A * 3/1939 Hymans ..... B66B 5/22 187/376
3,869,024 A * 3/1975 Hauth ..... F16D 55/228 188/72.5
4,819,765 A * 4/1989 Winkler ..... B66B 5/22 187/376
5,096,020 A * 3/1992 Korhonen ..... B66B 5/22 187/359
5,363,942 A * 11/1994 Osada ..... B66B 5/22 187/376
9,598,264 B2 * 3/2017 Mizuno ..... B66B 5/22
(Continued)

FOREIGN PATENT DOCUMENTS

CN 203497872 U 3/2014
JP 2017048011 A * 3/2017
(Continued)

OTHER PUBLICATIONS

European Search Report for application EP 16187909.3, dated Jan. 30, 2017, 5pgs.

*Primary Examiner* — Diem M Tran
(74) *Attorney, Agent, or Firm* — Cantor Colburn LLP

(57) ABSTRACT

The present invention provides a safety device for elevators, which belongs to the field of elevator safety technologies. The safety device for elevators includes a housing; a safety piece having a guide rail groove, the safety piece being disposed in the housing; and asymmetric active and counter wedges that are slidably disposed on the safety piece at both sides of the guide rail groove, respectively. Moreover, the device further includes a U-shaped elastic element and a blocking piece that are disposed on the safety piece. The safety device for elevators can provide a relatively stable arresting force, is reliable in repetitive work, achieves high safety, is relatively easy as well as fast and efficient in restoration, and is especially suitable for high-speed elevators.

17 Claims, 4 Drawing Sheets

(56) References Cited

U.S. PATENT DOCUMENTS

| | | | | |
|---|---|---|---|---|
| 2008/0128218 | A1* | 6/2008 | Gremaud | B66B 5/22 187/250 |
| 2016/0200549 | A1* | 7/2016 | Billard | B66B 5/22 188/65.1 |

FOREIGN PATENT DOCUMENTS

| | | | |
|---|---|---|---|
| SU | 1361097 | A2 | 12/1987 |
| WO | 2015038116 | A1 | 3/2015 |

* cited by examiner

SAFETY DEVICE FOR ELEVATORS

PRIORITY

This application claims priority to Chinese Patent Application No. CN201510564637.8, filed Sep. 8, 2015, and all the benefits accruing therefrom under 35 U.S.C. § 119, the contents of which in its entirety are herein incorporated by reference.

TECHNICAL FIELD

The present invention belongs to the field of elevator safety technologies and relates to a safety device for elevators for decelerating or braking elevators.

BACKGROUND ART

A safety device for elevators may also be referred to as a "safety arrester", which is an indispensable component of an elevator to guarantee safe operation of the elevator. With increasing requirements on safety and reliability of the elevator, requirements on deceleration or braking performance of the safety device for elevators are also increased.

The safety device for elevators is generally provided with a wedge, and in a normal operation of a common elevator, the wedge and a guide rail of the elevator are not in contact (there is a gap distance between the two), and in a deceleration or braking process, the arrestment similar to braking is caused by a frictional force between the wedge and the guide rail of the elevator, where the magnitude of the frictional force reflects the magnitude of an arresting force exerted on the guide rail. For example, when the elevator is in an abnormal state such as fast dropping, a speed limiter disposed in the elevator is used to judge whether a current dropping speed exceeds a predetermined speed value; if the current dropping speed exceeds the predetermined speed value, the speed limiter triggers an action, and further triggers a pulling transmission component of the elevator to act on the wedge of the safety device for elevators, so that a frictional force is generated between the wedge and the guide rail. The frictional force further pulls the wedge to move upward; therefore, the frictional force is increased rapidly, the wedge clamps the guide rail in a self-locking manner, and an elevator car stops moving, thus guaranteeing operation safety of the elevator.

When classification is carried out according to wedge structures, safety devices for elevators can be classified as symmetric arresters and asymmetric arresters. The U.S. Pat. No. 481,965, which is entitled "Arrester Device for Elevators" and belongs to the prior art, discloses an asymmetric arrester device, including an active wedge and a counter wedge that are asymmetrically disposed on both sides of a guide rail. In a deceleration or braking process, a downward acting force is exerted on the counter wedge through an elastic force of multiple disc springs disposed above the counter wedge, thereby obtaining a desired stable frictional force (that is, an arresting force) that can arrest an elevator car. However, such an asymmetric arrester device has at least the following disadvantages: (1) the force value repeatability of the elastic force generated by the multiple disc springs is poor, and therefore, the working stability of the safety device is easily affected; (2) a force value of the elastic force that can be exerted by the multiple disc springs depends on the number of disc springs superposed, and due to restrictions such as space, the force value of the elastic force that can be generated by the disc springs is usually limited, and a braking effect on a high-speed elevator may be undesirable; (3) due to an excessively high stiffness and an excessively small deformation amount, the disc springs are extremely sensitive to wear of the wedge; as the wear of the wedge changes, the elastic force that is generated by the disc springs when the active wedge moves upward to a predetermined position decreases significantly, the desired frictional force (that is, the arresting force) is hard to achieve, and therefore, there exists a potential safety hazard.

SUMMARY OF THE INVENTION

To solve one or more aspects of the foregoing problems, the present invention provides a safety device for elevators, including: a housing; a safety piece having a guide rail groove, the safety piece being disposed in the housing; asymmetric active and counter wedges that are slidably disposed on the safety piece at both sides of the guide rail groove, respectively; and the safety device for elevators further including a U-shaped elastic element and a blocking piece that are disposed on the safety piece;

wherein a guide groove is disposed in the safety piece, the blocking piece is capable of moving approximately upward along the guide groove during at least part of a braking process, and the guide groove and the blocking piece are configured to be capable of stopping, during at least a restoration process, a pre-tightening force generated by the U-shaped elastic element from being transferred to the counter wedge; and a lower U-shaped end of the U-shaped elastic element fixedly acts on a lower end surface of the safety piece, and an upper U-shaped end of the U-shaped elastic element elastically acts on an upper end surface of the blocking piece, and transfers, through the blocking piece during the at least part of the braking process, at least part of an elastic force of the U-shaped elastic element to the counter wedge that interacts with a lower end surface of the blocking piece.

Through the following detailed description with reference to the accompanying drawings, the foregoing features and operations of the present invention will become evident, and advantages of the present invention will also become more complete and clearer.

DETAILED DESCRIPTION

Figure 1:
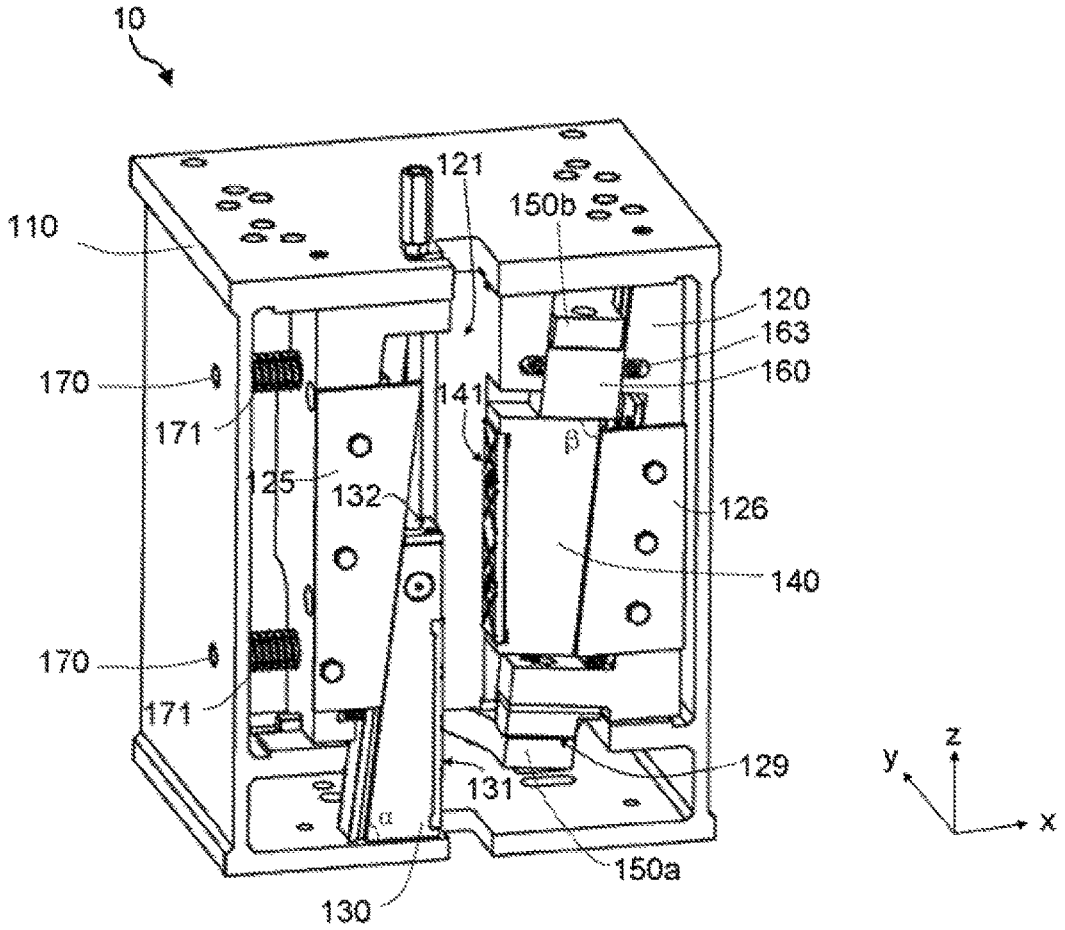
FIG. 1 is a 3D schematic structural front view of a safety device for elevators according to an embodiment of the present invention.

The present invention will be described more completely with reference to the accompanying drawings. Exemplary embodiments of the present invention are shown in the accompanying drawings. However, the present invention may be implemented according to many different forms, and should not be construed as being limited to the embodiments illustrated herein. On the contrary, these embodiments are provided to make the disclosure of the present invention thorough and complete, and convey the conception of the present invention to those skilled in the art completely. In the accompanying drawings, same reference numerals refer to same elements or components, and therefore, the description thereof is omitted.

Herein, the orientation terms: "upper", "lower", "front", "rear", "left" and "right" are defined in the directions shown in FIG. 1, where FIG. 1 shows a 3D structural diagram, viewed approximately from the front, of a safety device for elevators in normal use according to the present application; it should be understood that, these directional terms are relative concepts, and they are used for relative description and clarity, and may change accordingly as the placement orientation of the safety device for elevators changes.

Figure 2:
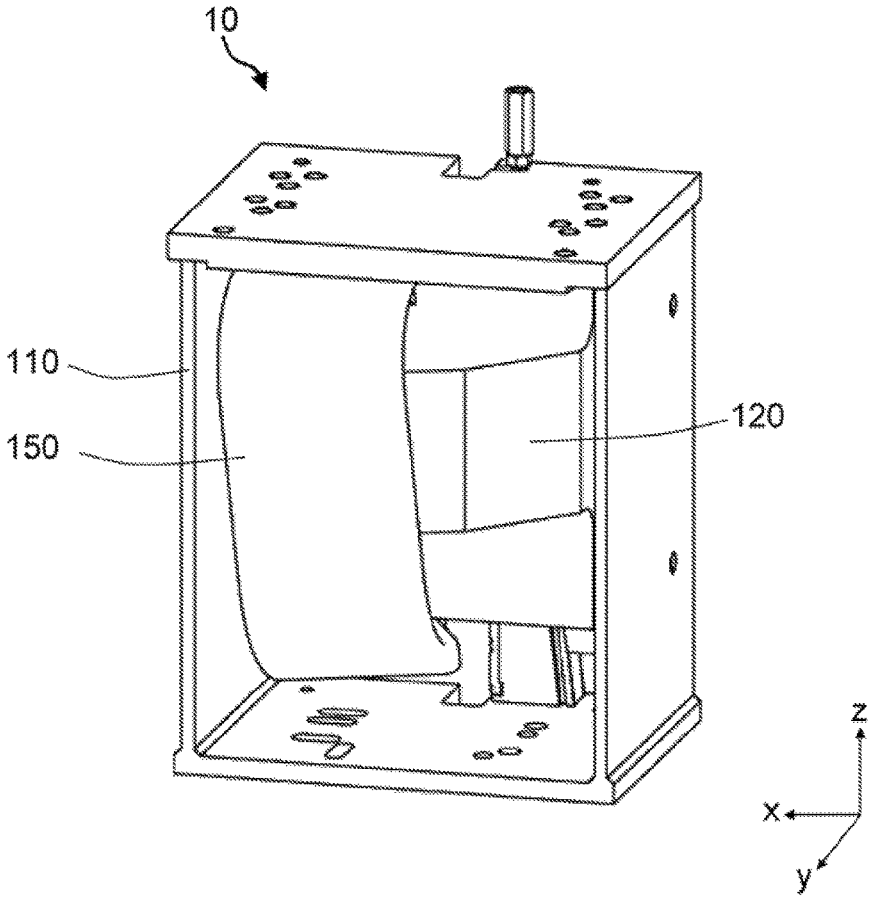
FIG. 2 is a 3D schematic structural rear view of a safety device for elevators according to an embodiment of the present invention.
Figure 3:
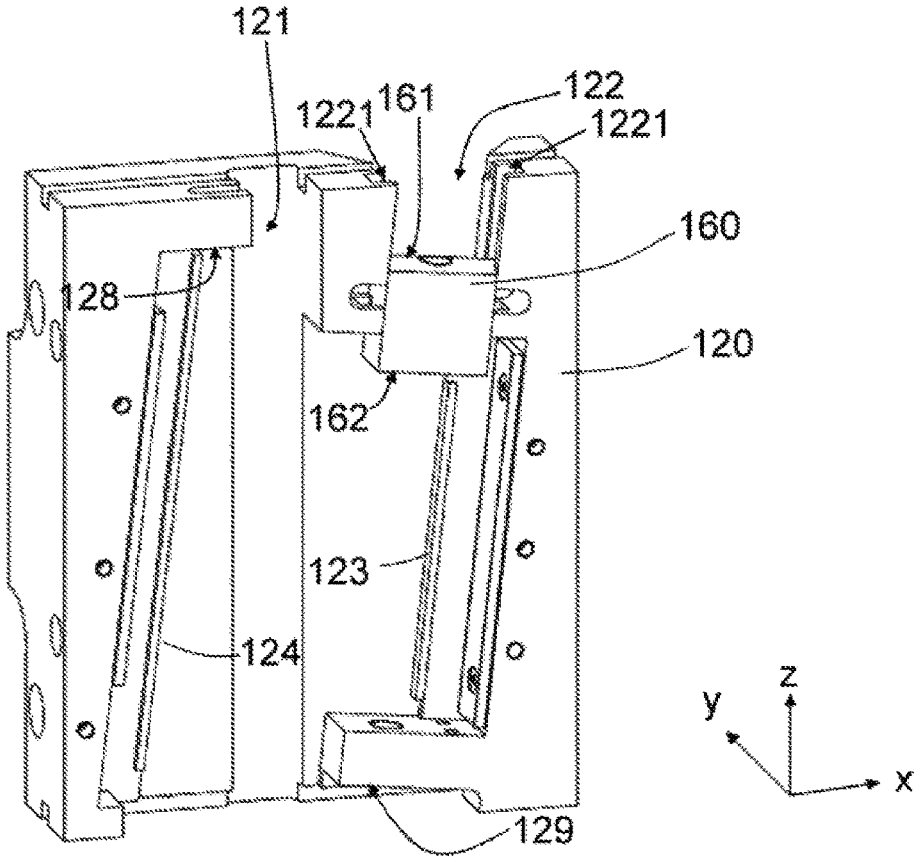
FIG. 3 is a 3D schematic structural front view of a safety piece in the safety device for elevators of the embodiment shown in FIG. 1.
Figure 4:
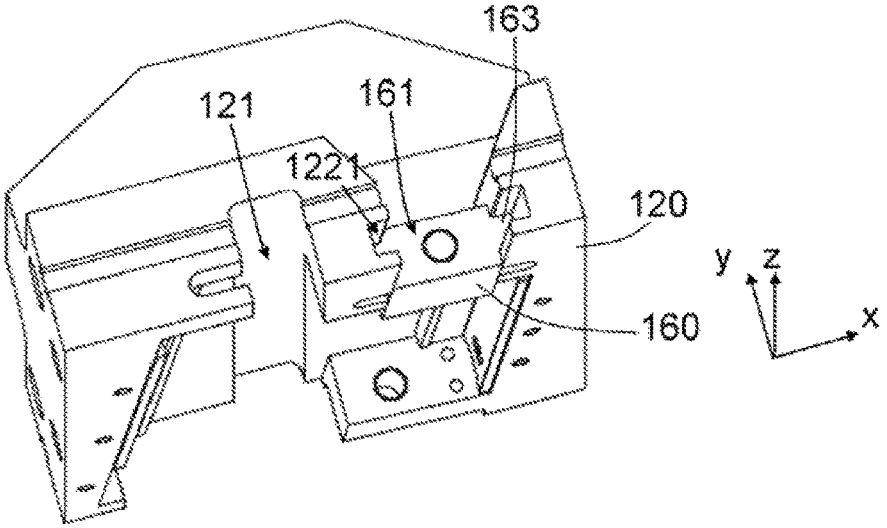
FIG. 4 is a 3D schematic structural top view of a safety piece in the safety device for elevators of the embodiment shown in FIG. 1.

FIG. 1 shows a 3D schematic structural front view of a safety device for elevators according to an embodiment of the present invention; FIG. 2 shows a 3D schematic structural rear view of a safety device for elevators according to an embodiment of the present invention; FIG. 3 shows a 3D schematic structural front view of a safety piece in the safety device for elevators of the embodiment shown in FIG. 1; and FIG. 4 shows a 3D schematic structural top view of a safety piece in the safety device for elevators of the embodiment shown in FIG. 1. In FIG. 1 to FIG. 4, a movement direction of the elevator, that is, a direction of the guide rail, is defined as a z-axis direction, and a vertically upward direction is defined as a positive direction of the z-axis; a direction horizontally perpendicular to the guide rail is defined as an x-axis direction, and a horizontally rightward direction is defined as a positive direction of the x-axis; a direction horizontally perpendicular to the wedge is defined as a y-axis direction, and a direction perpendicularly pointing to the safety piece from the wedge is defined as a positive direction of the y-axis.

Referring to FIG. 1 and FIG. 2, a safety device 10 for elevators mainly includes a housing 110, a safety piece 120, an active wedge 130, a counter wedge 140, a U-shaped elastic element 150, and a blocking piece 160. The housing 110 is approximately set as a cuboid structure, and may be made of a high-strength material; the safety piece 120, the active wedge 130, the counter wedge 140, the U-shaped elastic element 150, the blocking piece 160, and the like are disposed in an inner space of the housing 110.

The safety piece 120 is disposed in the housing 110 via a pin column 170 that is approximately disposed along the x-direction, and the movement of the safety piece 120 along the z-direction is limited by means of the pin column 170. A spring 171 disposed on the pin column 170 is located between the housing 110 and the left side of the safety piece 120, and can exert a pressure on a side surface of the left side of the safety piece 120, thereby limiting the movement of the safety piece 120 along the x-direction. For a specific structure of the safety piece 120, refer to FIG. 3 and FIG. 4. A middle portion of the safety piece 120 is provided with a guide rail groove 121 along the z-direction, which is used to receive a guide rail of an elevator, and the guide rail groove 120 is correspondingly aligned with a notch of the housing 110, so that in normal operation, the guide rail can move up and down freely with respect to the safety device 10 for elevators.

Referring to FIG. 1 and FIG. 2 continuously, both sides of the guide rail groove 121 of the safety piece 120 are provided with the active wedge 130 and the counter wedge 140 respectively. In this embodiment, the active wedge 130 is disposed on the left side of the guide rail groove 121, and the counter wedge 140 is disposed on the right side of the guide rail groove 121. However, it should be understood that, by symmetrically transforming the structure of the safety piece 120 with respect to the guide rail groove 121, the active wedge 130 and the counter wedge 140 may also be disposed on the right side and the left side of the guide rail groove 121 respectively. In this embodiment, the active wedge 130 and the counter wedge 140 are respectively disposed on slide rail grooves 124 and 123 that are on the left and right sides of the safety piece 120, and the active wedge 130 and the counter wedge 140 may be provided rollers or similar elements respectively, so that under the effect of an external force, they can slide up and down along the slide rail grooves 124 and 123 respectively. Therefore, the active wedge 130 and the counter wedge 140 are movable wedges, and the arrangement of specific sliding structures thereof with respect to the safety piece 120 is not limited.

It will be understood that, as the slide rail grooves 124 and 123 are integrally formed with the safety piece 120, it is sure that the slide rail grooves 124 and 123 are completely fixed with respect to the safety piece 120, and they can also be regarded as "fixed wedges" as opposed to the movable wedge. Moreover, in this embodiment, a left cover plate 125 and a right cover plate 126 (as shown in FIG. 1) are further provided corresponding to the active wedge 130 and the counter wedge 140 respectively. The left cover plate 125 and the right cover plate 126 are specifically fixed on the safety piece 120 via bolts. The left cover plate 125 and the right cover plate 126 may also be regarded as a part of the "fixed wedges" respectively.

In this embodiment, the active wedge 130 is a right-trapezoid block, and an xy cross section thereof is approximately a right trapezoid. As shown in FIG. 1, the active wedge 130 has an upper end surface 132, and a friction surface 131 toward the guide rail (not shown in the figure) in the guide rail groove 121, where a self-locking angle $\alpha$, that is, a base angle of the trapezoid, is formed between a lower bottom surface and a trapezoid inclined surface on the left side. The self-locking angle $\alpha$ also reflects angle setting of an inclined surface where the slide rail groove 124 is located, that is, the slide rail groove 124 has an angle of inclination substantially the same as that of the trapezoid inclined surface (the inclined surface on the left side) of the active wedge 130. In a braking process, the active wedge 130 moves upward along the slide rail groove 124, and therefore the friction surface 131 moves leftwards to get closer to the guide rail in the guide rail groove 121; meanwhile, the active wedge 130 presses the slide rail groove 124 of the safety piece 120 leftwards, and the slide rail groove 124 exerts a rightward counter force on the active wedge 130, that is, a positive pressure F exerted by the active wedge 130 on the guide rail is increased, thus increasing a frictional force. Therefore, in the braking process, the active wedge 130 has an effect of actively implementing braking, thus being referred to as an "active" wedge.

In case of normal operation of the elevator (when the safety device 10 for elevators does not work), the active wedge 130 is located at a lowermost end and is in direct contact with the housing 110 (as shown in FIG. 1), and upon detecting that the speed of an elevator car exceeds a predetermined value, a speed limiter of the elevator triggers a pulling transmission component of the elevator to pull the active wedge 130 to start to move upward. A travel distance of the active wedge 130 in the slide rail groove 124 is configurable, that is, a travel distance of the upward movement of the active wedge 130 is configurable, and may be configured by using the height of the active wedge 130 and/or the height of an inner top surface 128 of the safety piece 120 (as shown in FIG. 3); when the active wedge 130 moves to an uppermost end, the upper end surface 132 of the active wedge 130 contacts the inner top surface 128 of the safety piece 120, thus being blocked. In this case, an x-direction component of the force exerted by the safety piece 120 on the active wedge 130, that is, the positive pressure F exerted by the active wedge 130 on the guide rail, substantially reaches a maximum value.

Referring to FIG. 1 continuously, the counter wedge 140 is an upside-down right-trapezoid block, and an xy cross section thereof is approximately an upside-down right trapezoid. As shown in FIG. 1, the counter wedge 140 also as a relatively wide upper end surface, a friction surface 141 toward the guide rail (not shown in the figure) of the guide rail groove 121, and a lower bottom surface and a trapezoid inclined surface that are relatively narrow, where a self-locking angle β is formed between the upper end surface and the trapezoid inclined surface on the right side. The self-locking angle β also reflects angle setting of an inclined surface where the slide rail groove 123 is located, that is, the slide rail groove 123 has an angle of inclination substantially the same that of as the trapezoid inclined surface (the inclined surface on the right side) of the counter wedge 140. Because the upper end surface of the counter wedge 140 is wider than the lower bottom surface, when the counter wedge 140 is driven to move upward under the effect of the frictional force with the guide rail, the friction surface 141 will move rightward to be away from the guide rail in the guide rail groove 121, which therefore helps increase a distance between the friction surface 131 and the friction surface 141, thereby facilitating reduction of the positive pressure F exerted by the friction surface on the guide rail. Therefore, in the braking process, when the active wedge 130 and the counter wedge 140 move upward simultaneously, the counter wedge 140 generates a counter effect with respect to the active wedge 130, and therefore is referred to as a "counter" wedge.

By setting the self-locking angle α of the active wedge 130 and the self-locking angle β of the counter wedge 140, the distance between the two opposite friction surfaces 131 and 141 can be reduced when the active wedge 130 and the counter wedge 140 are moving upward simultaneously. Exemplarily, the self-locking angle α is set within a range of 5°-11°, the self-locking angle β is set within a range of 4°-10°, and the self-locking angle β is 0.5°-1.5° smaller than the self-locking angle α. In this way, even when the counter wedge 140 moves upward simultaneously with the active wedge 130, the positive pressure F exerted by the two wedges on the guide rail still increases, realizing a self-locking effect.

Referring to FIG. 1 and FIG. 2 continuously, a U-shaped surface of the U-shaped elastic element 150 is approximately vertically disposed, and a U-shape opening thereof faces towards a negative direction of the y-direction, so that at least the counter wedge 140 and the blocking piece 160 can be disposed within the U-shape opening of the U-shaped elastic element 150. In this embodiment, above the counter wedge 140, the safety piece 120 is correspondingly provided with a guide groove 122 (referring to FIG. 3 and FIG. 4) that is at least used to receive the blocking piece 160. Specifically, left and right inner sides of the guide groove 122 are each provided with a guide rail groove 1221, and left and right external sides of the blocking piece 160 are each correspondingly provided with a pin 163 that protrudes outward. In this way, machining is relatively easy to implement and the pin 163 is limited in the guide rail groove 1221 to slide along the guide rail groove 1221. For example, when the counter wedge 140 acts upwardly on the lower end surface 162 of the blocking piece 160, the blocking piece 160 can move upward, in the guide groove 122, approximately simultaneously with the counter wedge 140. An angle of inclination of the guide groove 122 may be set to be the same as the angle of inclination of the slide rail groove 123, that is, having a same size as β; in this way, the U-shaped surface of the U-shaped elastic element 150 also has the same angle of inclination, that is, an angle of inclination with respect to the xy plane also has an approximately same size as β.

A U-shaped bottom portion of the U-shaped elastic element 150 is disposed in the rear of the safety device 10 for elevators (as shown in FIG. 2). The U-shaped opening end of the U-shaped elastic element 150 includes a lower U-shaped end 150*a* and an upper U-shaped end 150*b*, the lower U-shaped end 150*a* fixedly acts on a lower end surface 129 of the safety piece 120, and the upper U-shaped end 150*b* acts on an upper end surface 161 of the blocking piece 160. Therefore, an inward contraction elastic force of the U-shaped elastic element 150 can be transferred to the counter wedge 140 through the blocking piece 160.

In the normal operation of the elevator, the counter wedge 140 falls at a lower position, the lower bottom surface of the counter wedge 140 may be seated on a support elastic element (which is not shown in the figure) that is located below the counter wedge 140 and between the counter wedge 140 and the safety piece 120, and the upper end surface of the counter wedge 140 is in contact with the blocking piece 160, but the counter wedge 140 substantially exerts no upward acting force on the blocking piece 160. To relatively fixedly dispose the U-shaped elastic element 150 on the safety piece 120, pre-tightening forces need to be respectively biased on the lower end surface 129 and the upper end surface 161 of the blocking piece 160 through the lower U-shaped end 150*a* and the upper U-shaped end 150*b* of the U-shaped elastic element 150. Therefore, the "pre-tightening force" defines an elastic force generated when the U-shaped elastic element 150 is initially installed on the safety device 10.

In this embodiment, a bottom portion of the guide rail groove 1221 is provided with a blocking portion (not shown in FIG. 3 and FIG. 4). When the counter wedge 140 exerts no acting force upwardly, the blocking portion blocks the pin 163, to implement blocking the downward movement of the blocking piece 160, so that almost all the pre-tightening force generated by the U-shaped elastic element 150 is exerted on the blocking portion (that is, on the safety piece 120), which can realize a function of stopping or even preventing the pre-tightening force generated by the U-shaped elastic element 150 from being transferred to the counter wedge 140. In the following description about the working principle of the safety device 10 for elevators, advantages and effects brought by the function can be understood.

The U-shaped elastic element 150 may be, for example, a U-shaped spring, and the amount of deformation thereof is mainly embodied by a change of distance between the lower U-shaped end 150*a* and the upper U-shaped end 150*b*. Parameters such as stiffness and a U-shaped opening width of the U-shaped elastic element 150 may be set according to parameters such as a stable frictional force (predetermined maximum frictional force) desired by the safety device 10 for elevators, and a distance by which the counter wedge 140 is capable of moving upward. Compared with that of a disc spring, an elastic force generated by the U-shaped elastic element 150 under an amount of deformation is stable in magnitude and fully repeatable.

The width of the blocking piece 160 is substantially equal to the width of the guide groove 122, and the height and/or stiffness of the blocking piece 160 can be determined according to parameters such as the opening width of the U-shaped elastic element 150, the stable frictional force desired by the safety device 10 for elevators, and the distance by which the counter wedge 140 is capable of moving upward.

The safety device 10 for elevators according to the embodiment of the present invention is installed under an elevator car, and provides an arresting force for the elevator car. The basic working principle of the safety device 10 for elevators according to the embodiment of the present invention is further described below.

Normal Operation of the Elevator

In the normal operation of the elevator, the safety device 10 for elevators does not need to provide any arresting force for the elevator car. As shown in FIG. 1, the active wedge 130 falls at a lowest position, that is, falls on the safety piece 120; the counter wedge 140 also falls at a lowest position, and it falls on the support elastic element. In this case, a distance between the friction surface 131 and the friction surface 141 is maximum, and neither friction surface 131 nor friction surface 141 contacts the guide rail of the elevator, so that the operation of the elevator is not affected substantially.

Braking Process

In the braking process, the safety device 10 for elevators needs to provide an arresting force for the elevator car immediately. The pulling transmission component triggers the active wedge 130 to start to move upward. As the self-locking angle $\alpha$ is set, when the active wedge 130 ascends to a particular position, the friction surface 131 of the active wedge 130 starts to contact the guide rail, and a frictional force generated between the two continues to drive the active wedge 130 to move upward. Further, the distance between the friction surface 131 and the friction surface 141 becomes shorter, the friction surface 141 also starts to contact the guide rail, and driven by the frictional force, the counter wedge 140 also starts to tend to move upward. However, under the effect of the blocking piece 160, the counter wedge 140 firstly needs to overcome the pre-tightening force exerted by the U-shaped elastic element 150 on the blocking piece 160, and thus can move upward. In other words, at least part of the frictional force generated by the guide rail with respect to the counter wedge 140 can be transferred to the upper U-shaped end 150*b* of the U-shaped elastic element 150 through the blocking piece 160, and the elastic force generated by the U-shaped elastic element 150 can be transferred to the counter wedge 140 through the blocking piece 160, only when the frictional force generated by the guide rail with respect to the counter wedge 140 is greater than the pre-tightening force exerted by the U-shaped elastic element 150 on the blocking piece 160.

It will be understood that, the frictional force between the guide rail and the friction surface 131 or 141 is substantially equal to the friction coefficient multiplied by the positive pressure F (that is, a pressure vertically exerted on the guide rail). As the active wedge 130 continues to move upward, the active wedge 130 and the counter wedge 140 respectively press the safety piece 120 leftward and rightward more vigorously, parts toward the guide rail (that is, the positive pressure F) of counter forces that are exerted by the safety piece 120 respectively on the active wedge 130 and the counter wedge 140 increase, and the frictional force continues to increase. The blocking piece 160 and the counter wedge 140 start to move upward only when the frictional force between the guide rail and the counter wedge 140 can overcome the pre-tightening force generated by the U-shaped elastic element 150 and the gravity generated by the blocking piece 160. Meanwhile, the amount of deformation of the U-shaped elastic element 150 increases, and the contraction elastic force of the U-shaped elastic element 150 also increases; moreover, the elastic force can be at least partially transferred to the counter wedge 140 through the blocking piece 160, thereby increasing the positive pressure F. Meanwhile, it should be noted that, on the other hand, the upward movement of the counter wedge 140 also causes the friction surface 141 to move leftward, which also reduces the positive pressure F. In this process, because the active wedge 130 still moves upward continuously and the distance between the friction surface 131 and the 141 still decreases continuously, although the friction surface 141 moves leftward, the overall positive pressure F still increases.

After the active wedge 130 moves upward to a top end and is fixed, that is, after the active wedge 130 slides upward to the upper end surface 132 of the active wedge 130 to contact the inner top surface 128 of the safety piece 120, and be blocked and fixed, the active wedge 130 no longer contributes to increasing the positive pressure F. In this case, a transient dynamic equilibrium point is formed between the counter wedge 140 and the U-shaped elastic element 150. In other words, the counter wedge 140 is enabled to move to a position point (where the position point is not fixed, and may vary as the friction coefficient or the like changes), so that the magnitude of the frictional force between the counter wedge 140 and the guide rail substantially corresponds to an elastic force, which has a particular value, of the U-shaped elastic element 150 and substantially remains stable, the frictional force does not change significantly with the relative movement or the frictional coefficient between the guide rail and the friction surface 141, and the magnitude of the friction is the desired stable frictional force or arresting force. For example, if the frictional force cannot reach the desired magnitude because the positive pressure F is not large enough, the counter wedge 140 continues to move upward; therefore the elastic force of the U-shaped elastic element 150 increases, and a positive feedback helps increase the positive pressure F, till the frictional force reaches the desired magnitude. Further, for another example, if the frictional force cannot reach the desired magnitude because the friction coefficient changes (the friction coefficient between the friction surface 141 and the guide rail is variable, and may change with different working conditions), the counter wedge 140 continues to move upward; therefore the elastic force of the U-shaped elastic element 150 increases, and a positive feedback helps increase the positive pressure F, till the frictional force reaches the desired magnitude. Therefore, in this structure, the positive pressure F is fully self-adjustable with respect to the change of the friction coefficient.

After the dynamic equilibrium is reached, the magnitude of the frictional force is substantially stable, so that a substantially stable acceleration condition can be generated for the elevator car, achieving a desirable braking effect.

Figure 5:
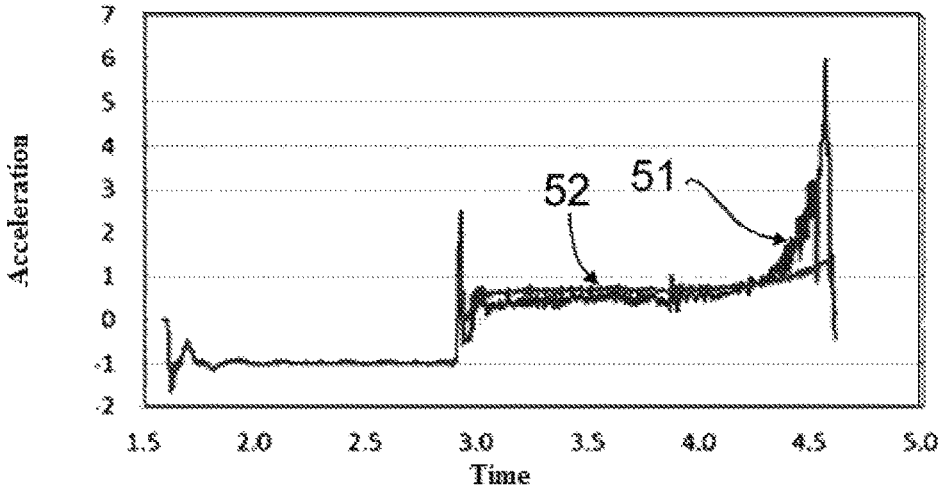
FIG. 5 is a plot of acceleration vs. time of a safety device for elevators.

FIG. 5 shows a plot of acceleration vs. time of the safety device for elevators according to an embodiment of the present invention. As shown in FIG. 5, 51 is a plot of acceleration vs. time of an existing safety device for elevators, 52 is a plot of acceleration vs. time of the safety device 10 for elevators, and the braking working process begins at the third second, where the friction coefficient fluctuates. It can be found by comparison that the safety device 10 for elevators in the embodiment of the present invention can obtain a stable acceleration condition in an arresting process (for example, an acceleration value is substantially stabilized at approximately 0.9 g), and a phenomenon of sudden acceleration climbing will not occur even when an arresting time increases.

It should be understood that, herein, the "stable" frictional force, arresting force or acceleration condition does not refer to a fixed numerical value without any change; instead, the frictional force, arresting force or acceleration condition may remain relatively stable within an interval range, and therefore, they are relative concepts.

Figure 6:
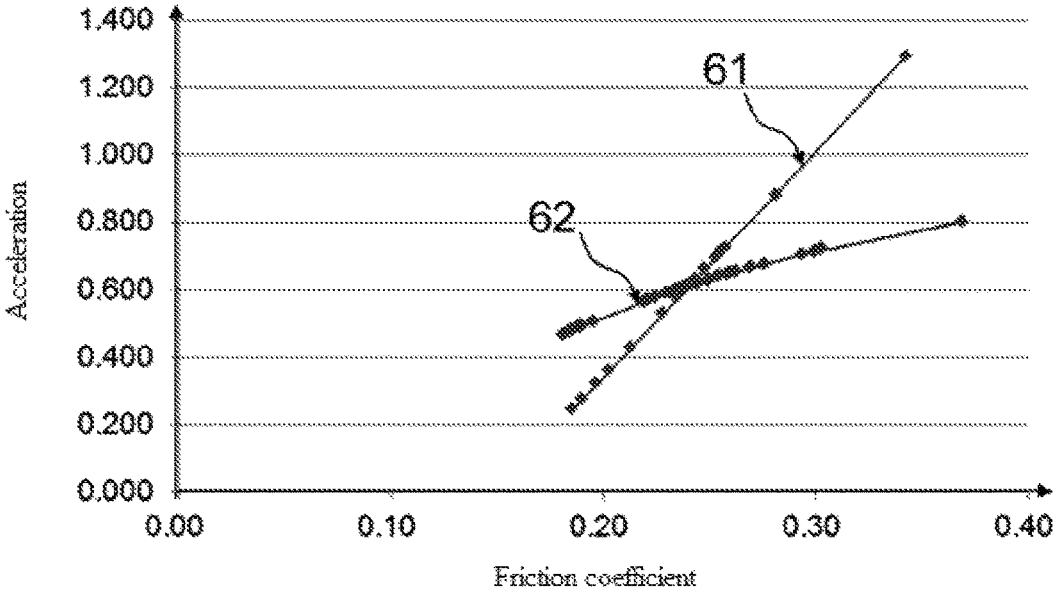
FIG. 6 is a plot of acceleration vs. friction coefficient of a safety device for elevators.

FIG. 6 shows a plot of acceleration vs. friction coefficient of the safety device for elevators according to an embodiment of the present invention. As shown in FIG. 6, 61 is a plot of acceleration vs. friction coefficient of an existing safety device for elevators, and 62 is a plot of acceleration vs. the friction coefficient of the safety device 10 for elevators, where it is reflected that the acceleration of the safety device 10 for elevators is more stable on the condition that the friction coefficient fluctuates.

It can be learned from the foregoing braking principle analysis that, in case where other parameter conditions are absolutely determined, at the foregoing dynamic equilibrium point, when the counter wedge 140 moves to a particular position point, a corresponding elastic force that the U-shaped elastic element 150 is capable of generating can be absolutely determined through calculation. Therefore, the corresponding elastic force that the U-shaped elastic element 150 is capable of generating at this position point may be set and determined in advance, to roughly determine the magnitude of the frictional force, so that the acceleration condition, which can be generated by the safety device 10 for elevators, is stable as desired. Specifically, the relatively stable frictional force or arresting force desired by the safety device 10 for elevators may be roughly obtained by setting the stiffness and/or opening width of the U-shaped elastic element 150. Therefore, the U-shaped elastic element 150 is one of crucial components of the safety device 10 for elevators.

The safety device 10 for elevators of this embodiment fully combines and utilizes performance features of the U-shaped elastic element 150. The elastic force generated by the U-shaped elastic element 150 under an amount of deformation is stable in magnitude and fully repeatable. Therefore, the acceleration condition that is desired to be generated after the dynamic equilibrium can be relatively stable; moreover, the U-shaped elastic element 150 has a relatively large amount of deformation, and the desired frictional force or acceleration condition can be easily set in an expanded range, which is flexible in design and is fully applicable to high-speed elevators requiring relatively high arresting acceleration. More importantly, even if the counter wedge 140 or the like is worn, the U-shaped elastic element 150 is relatively insensitive to the wear because the structure of the U-shaped elastic element 150 determines that it has smaller stiffness compared with a disc spring. Although the amount of deformation of the U-shaped elastic element 150 increases in the dynamic equilibrium condition due to the wear, and the desired frictional force changes, that is, the desired acceleration condition changes, the amount of deformation is still in a range relatively easy to accept, and the phenomenon that no arresting force can be generated will not occur at all, achieving desirable safety and reliability.

Moreover, it should be further understood that, especially in case where the blocking piece 160 is disposed to stop the pre-tightening force from being exerted on the counter wedge 160, in the foregoing braking process, while the counter wedge 140 is overcoming the pre-tightening force exerted by the U-shaped elastic element 150 on the blocking piece 160, the blocking piece 160 does not move upward, and the amount of deformation of the U-shaped elastic element 150 does not change, and the upper U-shaped end 150*b* does not move upward either, which helps reduce the amount of deformation of the U-shaped elastic element 150 in the dynamic equilibrium condition, and further helps expand a setting range of the desired acceleration condition.

Restoration Process

In the restoration process, the safety device 10 for elevators needs to restore a normal operation state from a braking state. An elevator control system drives the elevator car and the safety device 10 for elevators to move upward with respect to the guide rail, and the guide rail generates a downward frictional force against the active wedge 130 and the counter wedge 140 in contact with the guide rail on both sides, to drive the active wedge 130 and the counter wedge 140 to move downward. The active wedge 130 slides downward as being driven by the frictional force, causing the positive pressure F to decrease, and the counter wedge 140 also slides downward as being driven by the frictional force, causing the positive pressure F to increase. The decreasing speed of the positive pressure F is greater than the increasing speed thereof, and after the blocking piece 160 is restored to the original position as shown in FIG. 1, the pin 163 is blocked, stopping the pre-tightening force generated by the U-shaped elastic element 150 from being transferred to the counter wedge 140, which helps reduce the descending movement of the counter wedge 140, and thereby helps make the restoration process smoother.

Besides, it should be understood that, the safety device 10 for elevators of the embodiment of the present invention can ultimately generate a frictional force and acceleration of a relatively stable magnitude (as shown in FIG. 5) in the braking process, and will not generate an excessively large frictional force due to changes of the friction coefficient or the like; therefore, the active wedge 130 and the counter wedge 140 will not clamp the guide rail excessively tightly either, so that the restoration is easier and faster.

The examples above mainly illustrate the safety device for elevators of the present invention. Although only some implementation manners of the present invention are described, those of ordinary skill in the art should understand that the present invention can be implemented in many other forms without departing from the subject matter and scope of the present invention. Therefore, the demonstrated examples and implementation manners are regarded as being illustrative rather than limitative, and the present invention may cover various modifications and replacements without departing from the spirit and scope of the present invention as defined in the appended claims.

The invention claimed is:

1. A safety device for elevators, comprising: a housing; a safety piece having a guide rail groove, the safety piece being disposed in the housing; asymmetric active and counter wedges (130, 140) that are slidably disposed on the safety piece at both sides of the guide rail groove, respectively, the active wedge and counter wedge being asymmetric about the guide rail groove; and the safety device for elevators further comprising a U-shaped elastic element and a blocking piece that are disposed on the safety piece;

wherein a guide groove is provided in the safety piece, the blocking piece is capable of moving approximately upward along the guide groove during at least part of a braking process, and the guide groove and the blocking piece are configured to be capable of stopping, during at least a restoration process, a pre-tightening force generated by the U-shaped elastic element from being transferred to the counter wedge; and a lower U-shaped end of the U-shaped elastic element fixedly acts on a lower end surface of the safety piece, and an upper U-shaped end of the U-shaped elastic element elastically acts on an upper end surface of the blocking piece, and transfers, through the blocking piece during the at least part of the braking process, at least part of an elastic force of the U-shaped elastic element to the counter wedge that interacts with a lower end surface of the blocking piece;

the lower U-shaped end positioned on one side of the lower end surface of the safety piece and the counter wedge positioned on another side of the lower end surface of the safety piece;

the upper U-shaped end positioned on one side of the blocking piece and the counter wedge positioned on another side of the blocking piece.

2. The safety device for elevators according to claim 1, wherein the guide groove is provided with a blocking portion, which is configured to stop the pre-tightening force biased on the blocking piece from being further transferred to the counter wedge.

3. The safety device for elevators according to claim 2, wherein an inner side of the guide groove is provided with a guide rail groove, a bottom portion of the guide rail groove is provided with the blocking portion, an external side of the blocking piece is provided with a pin that protrudes outward, the blocking piece is limited in the guide rail groove via the pin and moves along the guide rail groove, and when the pin is blocked by the blocking portion, almost all the pre-tightening force generated by the U-shaped elastic element is exerted on the blocking portion.

4. The safety device for elevators according to claim 1, wherein a relatively stable frictional force desired by the safety device for elevators is obtained by disposing the U-shaped elastic element.

5. The safety device for elevators according to claim 4, wherein the relatively stable frictional force desired by the safety device for elevators is approximately obtained by setting at least one of stiffness and an opening width of the U-shaped elastic element.

6. The safety device for elevators according to claim 1, wherein the safety piece is fixed inside the housing via a pin column, and a spring located between the housing and the safety piece is provided on the pin column.

7. The safety device for elevators according to claim 1, wherein when the active wedge slides upward to an uppermost end, an upper end surface of the active wedge is in contact with an inner top surface of the safety piece and is thus blocked.

8. The safety device for elevators according to claim 1, wherein a first cover plate and a second cover plate are also respectively provided corresponding to the active wedge and the counter wedge, and the first cover plate and the second cover plate are fixed on the safety piece via bolts.

9. A safety device for elevators, comprising: a housing; a safety piece having a guide rail groove, the safety piece being disposed in the housing; asymmetric active and counter wedges that are slidably disposed on the safety piece at both sides of the guide rail groove, respectively; and the safety device for elevators further comprising a U-shaped elastic element and a blocking piece that are disposed on the safety piece;

wherein a guide groove is provided in the safety piece, the blocking piece is capable of moving approximately upward along the guide groove during at least part of a braking process, and the guide groove and the blocking piece are configured to be capable of stopping, during at least a restoration process, a pre-tightening force generated by the U-shaped elastic element from being transferred to the counter wedge; and a lower U-shaped end of the U-shaped elastic element fixedly acts on a lower end surface of the safety piece, and an upper U-shaped end of the U-shaped elastic element elastically acts on an upper end surface of the blocking piece, and transfers, through the blocking piece during the at least part of the braking process, at least part of an elastic force of the U-shaped elastic element to the counter wedge that interacts with a lower end surface of the blocking piece;

wherein the active wedge is a right-trapezoid block, the counter wedge is an upside-down right-trapezoid block, a trapezoid inclined surface of the active wedge and a lower bottom surface thereof define a first self-locking angle $\alpha$, a trapezoid inclined surface of the counter wedge and an upper end surface thereof define a second self-locking angle $\beta$, and the first self-locking angle $\alpha$ of the active wedge is smaller than the second self-locking angle $\beta$ of the counter wedge.

10. The safety device for elevators according to claim 9, wherein $5° \leq \alpha \leq 11°$, $4° \leq \beta \leq 10°$, and the second self-locking angle $\beta$ is 0.5°-1.5° smaller than the first self-locking angle $\alpha$.

11. The safety device for elevators according to claim 9, wherein an angle of inclination of the guide groove is substantially the same as the second self-locking angle $\beta$.

12. The safety device for elevators according to claim 9, wherein a first slide rail groove and a second slide rail groove are integrally provided on the safety piece, an angle of inclination of the first slide rail groove is the same as the first self-locking angle $\alpha$, and an angle of inclination of the second slide rail groove is the same as the second self-locking angle $\beta$.

13. The safety device for elevators according to claim 9, wherein an angle of inclination of a U-shaped surface of the U-shaped elastic element is substantially the same as the second self-locking angle $\beta$.

14. The safety device for elevators according to claim 9, wherein during a normal operation of an elevator, the blocking piece stops the pre-tightening force generated by the U-shaped elastic element from being transferred to the counter wedge.

15. The safety device for elevators according to claim 14, wherein during the normal operation of the elevator, a lower bottom surface of the counter wedge is seated on a support elastic element, and an upper end surface of the counter wedge is in contact with the blocking piece and substantially exerts no upward acting force on the blocking piece.

16. The safety device for elevators according to claim 15, wherein during the braking process, the counter wedge firstly needs to overcome the pre-tightening force exerted by the U-shaped elastic element on the blocking piece, and thus can approximately move upward along the guide groove.

17. A safety device for elevators, comprising: a housing; a safety piece having a guide rail groove, the safety piece being disposed in the housing asymmetric active and counter wedges (130, 140) that are slidably disposed on the safety piece at both sides of the guide rail groove, respectively, the active wedge and counter wedge being asymmetric about the guide rail groove; and the safety device for elevators further comprising a U-shaped elastic element and a blocking piece that are disposed on the safety piece;

wherein a guide groove is provided in the safety piece, the blocking piece is capable of moving approximately upward along the guide groove during at least part of a braking process, and the guide groove and the blocking piece are configured to be capable of stopping, during at least a restoration process, a pre-tightening force generated by the U-shaped elastic element from being transferred to the counter wedge; and a lower U-shaped end of the U-shaped elastic element fixedly acts on a lower end surface of the safety piece, and an upper U-shaped end of the U-shaped elastic element elastically acts on an upper end surface of the blocking piece, and transfers, through the blocking piece during the at least part of the braking process, at least part of an elastic force of the U-shaped elastic element to the counter wedge that interacts with a lower end surface of the blocking piece;

wherein when the active wedge slides upward to an uppermost end, an upper end surface of the active wedge is in contact with an inner top surface of the safety piece and is thus blocked;

wherein after the upper end surface of the active wedge is in contact with the inner top surface of the safety piece, the counter wedge is moved to a particular position point so that a frictional force between the counter wedge and the guide rail substantially remains stable.

* * * * *